US008176751B2

(12) United States Patent
Chen

(10) Patent No.: US 8,176,751 B2
(45) Date of Patent: May 15, 2012

(54) LOOPABLE AND WEARABLE DINING UTENSIL

(76) Inventor: Yu-Chiuan Chen, Taipei (TW)

( * ) Notice: Subject to any disclaimer, the term of this patent is extended or adjusted under 35 U.S.C. 154(b) by 310 days.

(21) Appl. No.: 12/606,214

(22) Filed: Oct. 27, 2009

(65) Prior Publication Data

US 2011/0095550 A1 Apr. 28, 2011

(51) Int. Cl.
*A44C 25/00* (2006.01)

(52) U.S. Cl. ..... 63/1.12; 63/1.16; 63/1.17; 63/3; 63/41; 294/5.5; 294/218

(58) Field of Classification Search ..... None
See application file for complete search history.

(56) References Cited

U.S. PATENT DOCUMENTS

| | | | | | |
|---|---|---|---|---|---|
| 452,830 | A * | 5/1891 | Harju | 224/220 |
| D150,655 | S * | 8/1948 | Reinecke | D11/2 |
| 2,453,190 | A * | 11/1948 | Boscowitz | 63/1.12 |
| 5,131,151 | A * | 7/1992 | Agase et al. | 30/327 |
| D335,637 | S * | 5/1993 | Azrielant | D11/4 |
| 5,305,934 | A * | 4/1994 | Grey | 224/617 |
| 5,810,411 | A * | 9/1998 | Major | 294/99.2 |
| 7,093,868 | B1 * | 8/2006 | Shen | 294/218 |
| 7,258,375 | B1 * | 8/2007 | Shen | 294/218 |
| 7,571,943 | B1 * | 8/2009 | Lee | 294/218 |
| 7,896,413 | B2 * | 3/2011 | Shen Ku | 294/218 |
| 2008/0135711 | A1 * | 6/2008 | Bunting | 248/328 |
| 2009/0229130 | A1 * | 9/2009 | Swierski et al. | 30/123 |

* cited by examiner

*Primary Examiner* — Jack W. Lavinder

(57) ABSTRACT

A loopable and wearable dining utensil comprises a rigid function portion for engaging food, a holder for holding the dining utensil, and a flexible connector for connecting the rigid function portion and the holder. One end of the rigid function portion also serves as a male linker and the opposite end has a first linking part. One end of the holder serves as a female linker for linking with the male linker, and the opposite end has a second linking part for linking with the first linking part. When the female linker is linked with the male linker, the dining utensil forms a loop, and when the second linking part is linked with the first linking part, the dining utensil forms a regular utensil. According to various connecting profiles, the multiple dining utensils can form a bracelet, necklace, belt or an ornament of handbag or hand-held mobile device.

20 Claims, 14 Drawing Sheets

LOOPABLE AND WEARABLE DINING UTENSIL

BACKGROUND OF THE INVENTION

1. Field of the Invention

The present invention relates to a portable dining utensil, and more particularly to a loopable and wearable dining utensil, for example a chopstick, a fork or a spoon. According to various connecting profiles, the multiple dining utensils can form a bracelet, necklace, belt or an ornament of handbag or hand-held mobile device.

2. Description of the Prior Art

As well known to those skilled in the art, a set of portable dining utensils is enclosed by a suitable carrying case for containing at least a pair of chopsticks and other dining utensils. In order to reduce the length of the carrying case, each chopstick is disassembled to a handle portion detachably connected to a food engaging portion. Freeman teaches a set of portable chopsticks in U.S. Pat. No. 6,328,360, granted on Dec. 11, 2001. FIGS. 1 through 2 are views illustrating the set of portable chopsticks of Freeman. a chopstick 10 is two-piece construction having an elongated member 11 terminating at one end in a rounded tip 12 which is intended to engage portions of food. The opposite end of member 11 is of square cross-section and is indicated by numeral 13. Outwardly projecting from the square end 13 is a stud 14 which is of a special configuration.

The chopstick 10 further includes a detachable holder 15 which is of square cross-section and includes a free end 16 constituting the extreme end of the chopstick. Engagement occurs when the stud 14 is inserted into a receiving recess 17 provided in the end of holder 15 broadly identified by numeral 18. Preferably, the shape of recess 17 is such that it will insertably receive the special shape of the stud 14. The recess 17 in the holder 15 is of lesser or smaller dimension than the overall cross-section of end 13 or end 18 so that when the stud is inserted into the recess, a smooth and continuous surface is provided on all four sides of the assembled chopstick 10.

FIG. 2 is a top plan view of a carrying case illustrating storage of the chopstick components. As shown in FIG. 2, it can be seen that the holders 15 for each of the pair of chopsticks is stored in a recess having the same shape as the holders. The two holders are indicated by numeral 15 and 15' respectively. In parallel spaced-apart relationship with the holders, there are provided two pairs of elongated members, indicated by numeral 11 and 11' as shown in FIG. 1 and numerals 22' and 22. For the holders 15 and 15', the pairs of members are placed in corresponding recesses so as to lie in parallel spaced-apart relationship in the insert 33. Preferably, the insert or material 33 may be employed to hold sanitary solution or other medium which would be effective to maintain the pairs of chopsticks and holders sanitary. In this configuration, a kit is provided and the kit may be easily carried in a coat pocket, a purse or other garments worn by the user. As described above, features of Freeman are the set of chopsticks including at least two pairs and a single set or pair of interchangeable handles. And the carrying or travel case is fabricated of materials that are heat resistant and readily cleansed so that the case is sanitary-independent of any embedded chemicals or separately included materials. The use of the chopsticks, per se, or in the carrying case is convenient, reusable and portable.

However, such a set of conventional portable chopsticks or generally known reusable chopsticks can be received in a carrying case resulting in reducing the length of the chopsticks but a total volume of the kit is more than that of the chopsticks due to the use of the case. The kit may be easily carried in a coat pocket or a purse but that is not easily carried in a shirt or trousers pocket worn by the user. If a purse is taken only for bringing the kit, users will abandon to use the kit due to an added burden for taking the purse when eating outside on weekdays. In addition, if other dining utensils such as a spoon are added to be received in the carrying case, a volume of the carrying case should increase. Thus, the carrying case could not receive other dining utensils through its initial size.

Although cleanness of the chopsticks can be implemented through the use of the carrying case and the sanitizing insert, the added burden of the kit should cause user to abandon to use when eating outside on weekdays. Cleanness and sanitation of the loopable and wearable dining utensil can be maintained through production of antibacterial plastic, ceramics, stainless steel or other metals which are energetically developed nowadays. Antibacterial surface treatment technologies are also a solution to maintain cleanness and sanitation of the loopable and wearable dining utensil. Thus, the cleanness and sanitation of dining utensils can be maintained through applications of antibacterial materials and antibacterial surface treatment, when carrying cases are excluded.

SUMMARY OF THE INVENTION

An objective of the present invention is to solve the above-mentioned problems and to provide a loopable and wearable dining utensil, for example a chopstick, a fork or a spoon, characterized by a simple structure and easy assembly to form a bracelet, necklace, belt or an ornament of handbag or hand-held mobile device.

The present invention achieves the above-indicated objective by providing loopable and wearable dining utensil. The dining utensil comprises a rigid function portion for engaging food, a holder for holding the dining utensil, and a flexible connector for connecting the rigid function portion and the holder. The rigid function portion has a tip terminating at one end for engaging food, wherein the tip also serves as a male linker and the opposite end of the rigid function portion has a first linking part. The holder has one end serving as a female linker and the opposite end having a second linking part, wherein the female linker is used for linking with the male linker and the second linking part is used for linking with the first linking part. The dining utensil forms a loop when the male linker is engaged with the female linker and the dining utensil forms a normal use dining utensil which has the flexible connector received in the inner of the dining utensil when the first linking part is engaged with the second linking part.

The following detailed description, given by way of example and not intended to limit the invention solely to the embodiments described herein, will best be understood in conjunction with the accompanying drawings.

DETAILED DESCRIPTION OF THE PREFERRED EMBODIMENTS

The present invention discloses a loopable and wearable dining utensil, for example a chopstick, a fork or a spoon. According to various connecting profiles, the multiple dining utensils can form a bracelet, necklace, belt or an ornament of handbag or hand-held mobile device. Preferably, the dining utensil is fabricated of antibacterial plastic, ceramics, stainless steel or other metals, or surfaces of the dining utensil are coated with antibacterial thin films through electroplating, chemical vapor deposition (CVD) or physical vapor deposition (PVD). Thus, the cleanness and sanitation of the loopable and wearable dining utensil can be maintained.

Embodiment 1

FIGS. 3-12 show aspects of a loopable and wearable fork in the embodiment 1 of the present invention.

Figure 1:
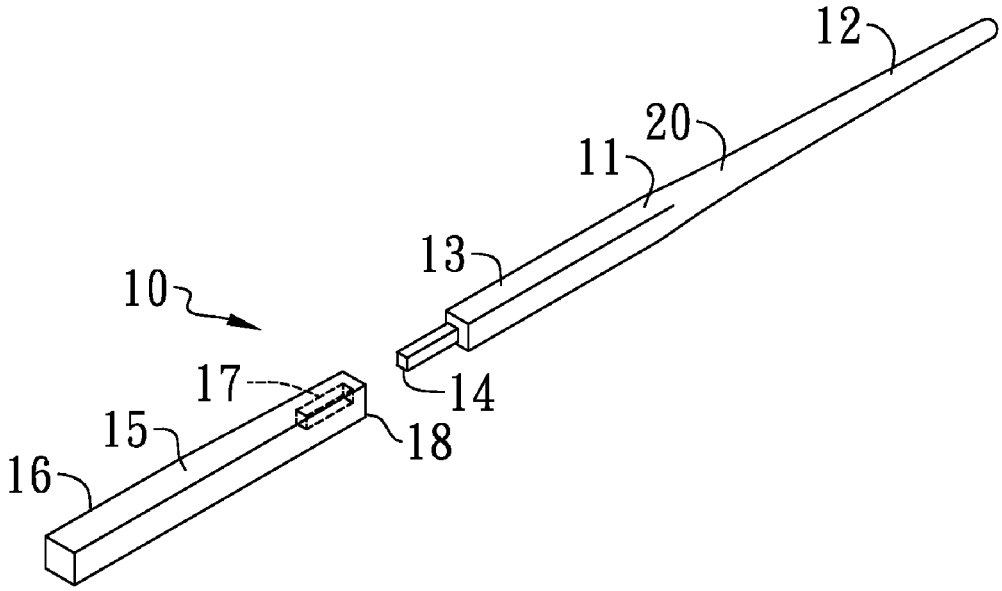
FIG. 1 (Prior Art)
FIG. 1 is an exploded perspective view of a conventional portable chopstick.
Figure 2:
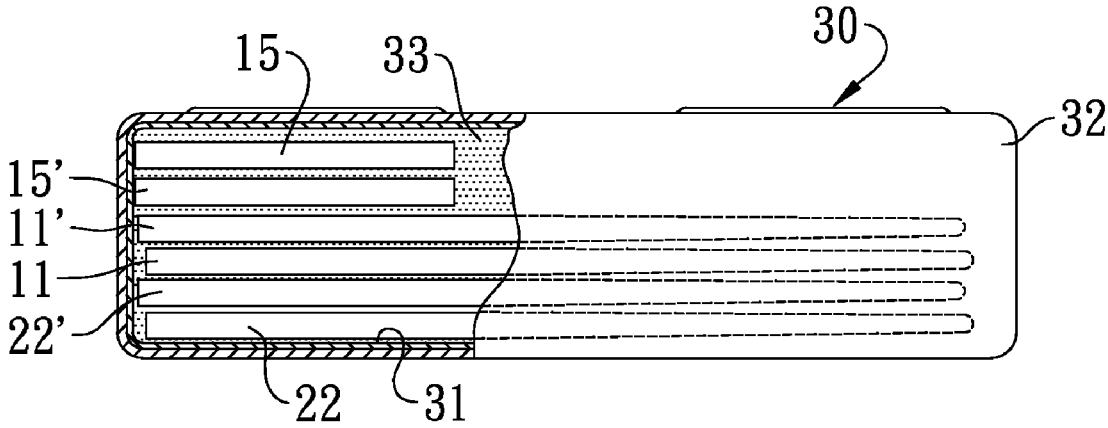
FIG. 2 (Prior Art)
FIG. 2 is a top plan view of a carrying case illustrating storage of the chopstick components.
Figure 3:
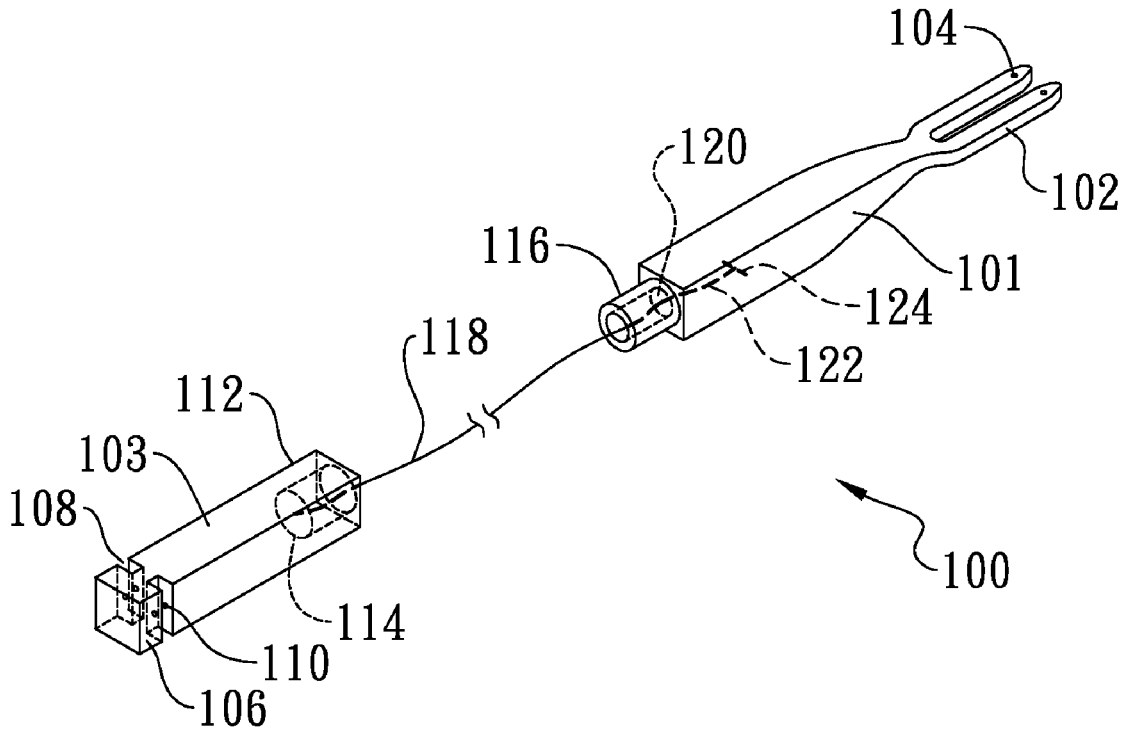
FIG. 3 is an exploded perspective view of a loopable and wearable fork of the present invention.
Figure 4:
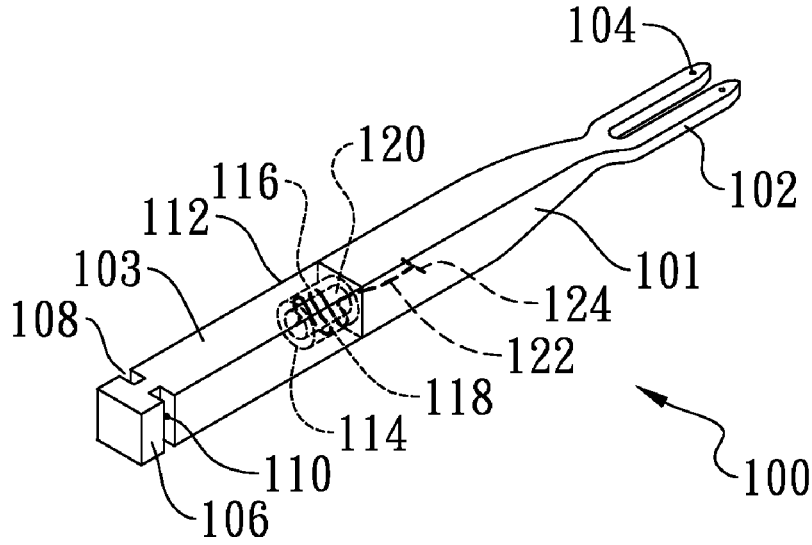
FIG. 4 is a perspective view of the fork of FIG. 3 forming a normal use fork.
Figure 9:
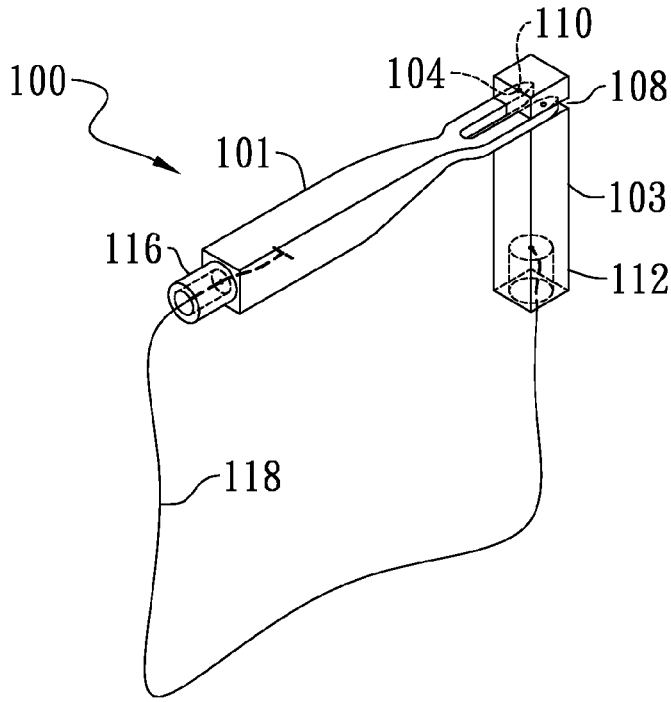
FIG. 9 is a perspective view of the fork of FIG. 3 forming a loop.

FIG. 3 is an exploded perspective view of a loopable and wearable fork. As shown in FIG. 3, a fork 100 includes a rigid function portion 101, a holder 103 and a flexible connector 118. The rigid function portion 101 in the embodiment 1 has a fork terminating at one end in a pair of splitting tips, which is intended to stick into portions of food, and the splitting tips also serve as a male linker 102. The opposite end of the rigid function portion 101 has a first linking part 116 which is of a round cross-section. The holder 103 is intended to hold the fork 100 and one end of the holder 103 serves as a female linker 106 used for linking with the male linker 102, and the opposite end has a second linking part 112 used for linking with the first linking part 116. The flexible connector 118 intended to connect the rigid function portion 101 and the holder 103 has a flexible member 122 and a stopper 124. The flexible member 122 has functions of bending, winding, folding, elongating or shrinking, and can be formed with elastic material. The fork 100 forms a loop when the male linker 102 is engaged with the female linker 106 of the holder 103, as shown in FIG. 9. The fork 100 forms a normal use fork which has the flexible connector 118 received in the inner of the fork when the first linking part 116 is engaged with the second linking part 112 of the holder 103, as shown in FIG. 4. Preferably, the shape of recess in the second linking part 112 is such that it will insertably receive the shape of the first linking part 116. The cross-section shape of the recess in the second linking part 112 and of the first linking part 116 can be a circle, curve, square or rectangle. An external diameter of the first linking part 116 is about equal to an internal diameter of the recess in the second linking part 112 so that when the first linking part 116 is inserted into the recess, a tight connection is formed with two-piece construction having a rigid frame for the assembled fork 100.

Figure 5A:
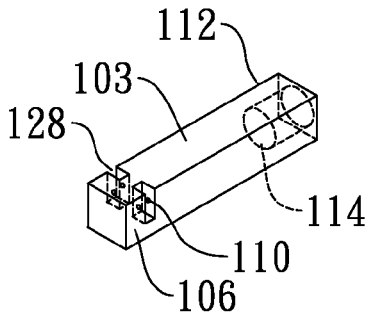
FIGS. 5A and 5B are perspective views of a holder of the fork
Figure 5B:
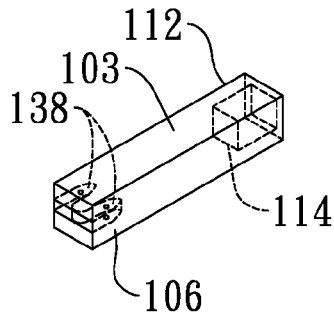

Two cavities 108 for engaging with the male linker 102 are formed in the female linker 106 of the holder 103. Dents 104 for locking with knots 110 which are formed on each middle site of sidewalls of the cavities 108 are formed on the tips of the male linker 102. A shape of the cavities 108 is adopted to fit the male linker 102 resulting in matched coupling formed by the cavities 108 and the male linker 102. Cavities can be formed in the bottom side of female linker 106 such as cavities 138 shown in FIG. 5B, and can be four sides closed cavities such as cavities 128 shown in FIG. 5A. FIGS. 5A and 5B are perspective views of a holder. A cross-section shape of the recess in the second linking part 112 is a circle in FIG. 5A, otherwise, a square in FIG. 5B.

Figure 6A:
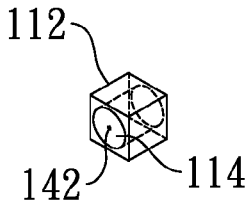
FIGS. 6A and 6B are perspective views of first linking part and second linking part respectively.
Figure 6B:
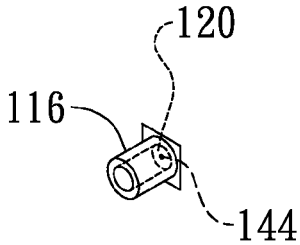
Figure 7A:
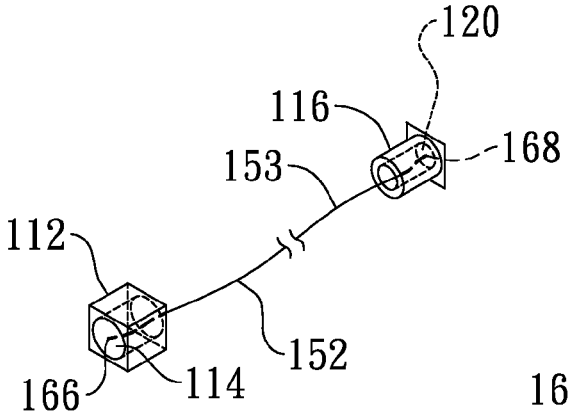
FIGS. 7A, 7B and 8 are perspective views of the flexible connector.
Figure 7B:
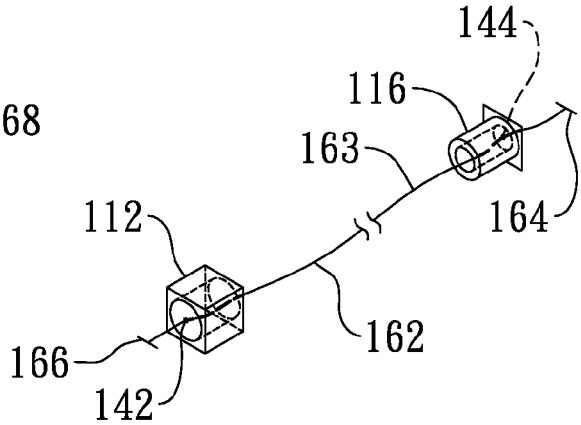
Figure 8:
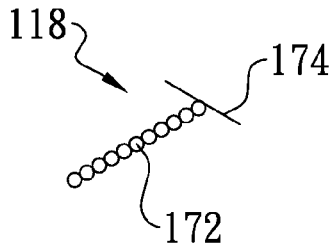

A bottom shield 120 is formed on the first linking part 116, and another bottom shield 114 is formed on the second linking part 112. Both the shields 120 and 114 are connected with the flexible connector 118. The flexible connector 118 can be simply fixed on both the shields 120 and 114 through using glue or metal welding such as flexible connector 152 shown in FIG. 7A. The flexible connector 152 includes a flexible member 153 with the same function to the flexible member 122. FIGS. 6A and 6B are perspective views of first linking part and second linking part respectively. As shown in FIGS. 6A and 6B, outlets 142 and 144 are formed on the shields 120 and 114 respectively. Thus, the shields 120 and 114 can be connected with the flexible connector 118 which is one end fixed and the other moveable, or two ends all moveable such as flexible connector 162 shown in FIG. 7B. The flexible connector 162 includes a flexible member 163 with the same function to the flexible member 122. Stoppers 164 and 166 are formed at two ends of the flexible connector 162 to prevent the flexible connector 162 from separating off the first linking part 116 and the second linking part 112. A shape of the flexible connector can be a wire, twist wire or chain. As shown in FIG. 8, the flexible connector 118 has a chain-shaped flexible member 172 and a stopper 174.

Figure 10:
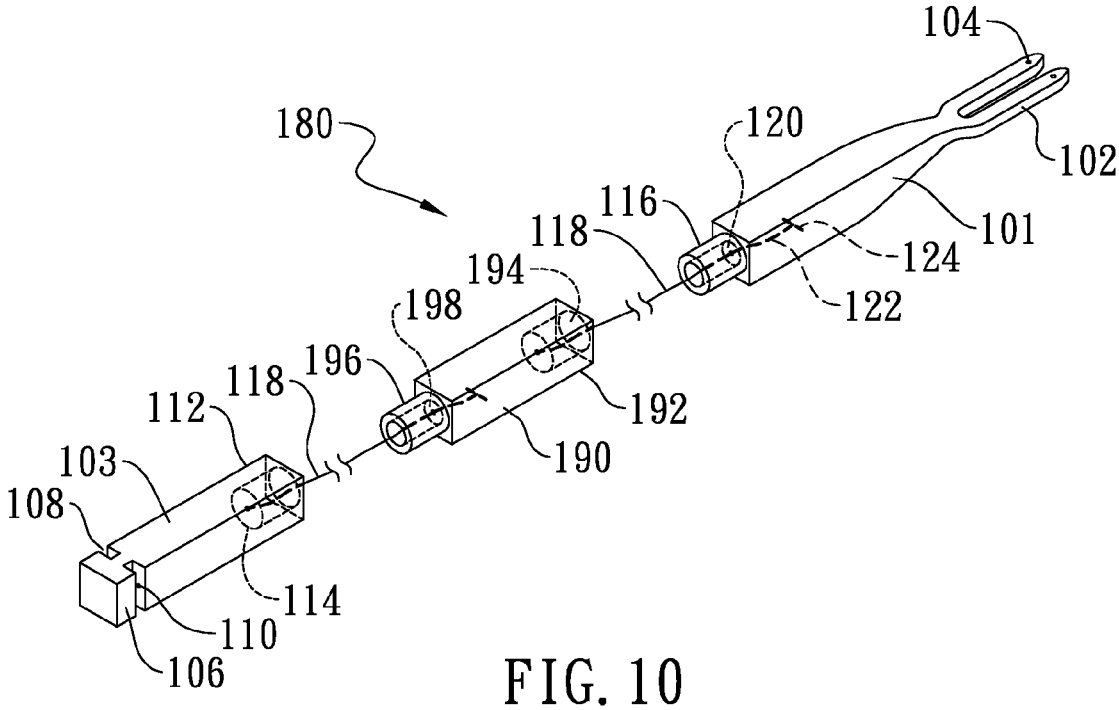
FIG. 10 is an exploded perspective view of a fork from which a rigid central portion is added to the fork of FIG. 3.
Figure 11:
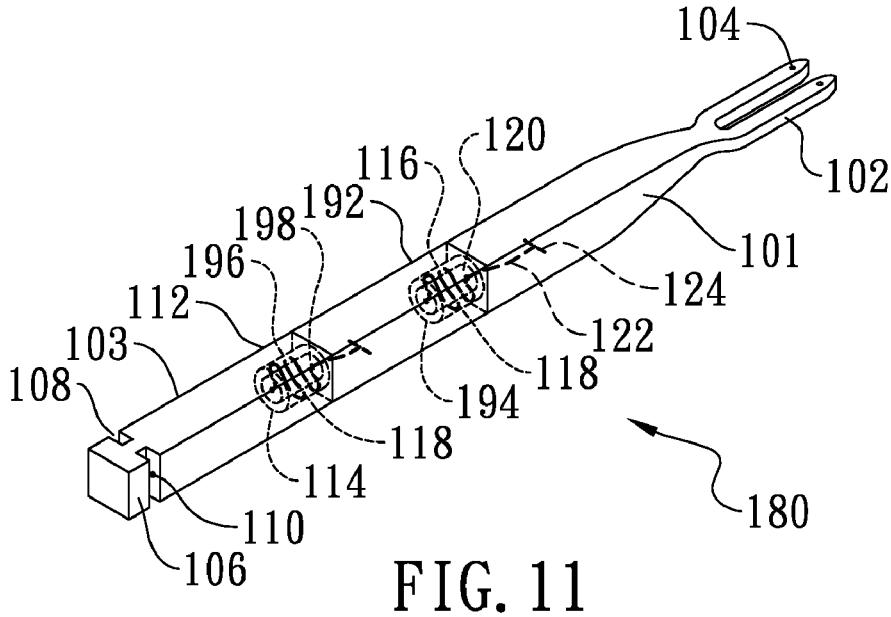
FIG. 11 is a perspective view of the fork of FIG. 10 forming a normal use fork.
Figure 12:
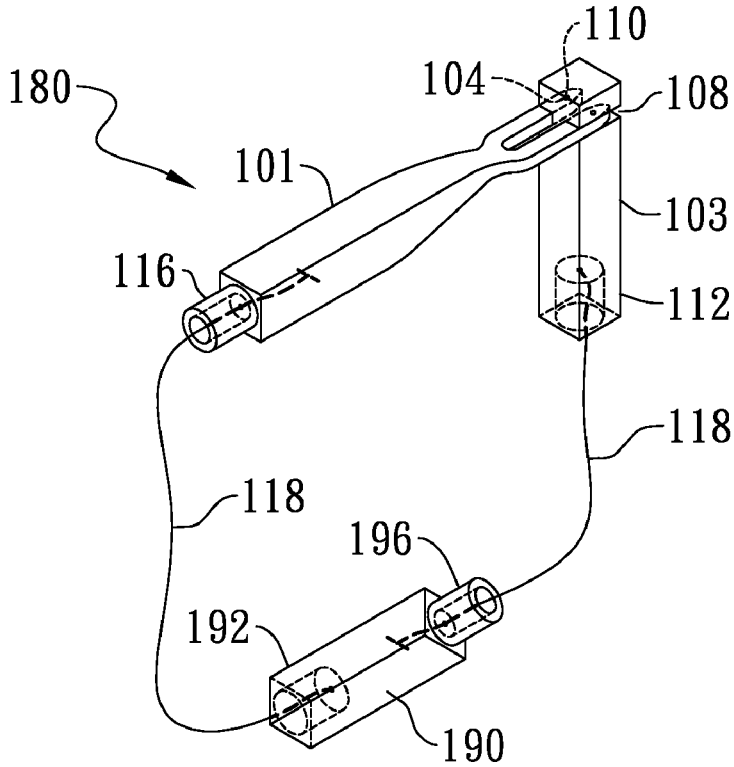
FIG. 12 is a perspective view of the fork of FIG. 10 forming a loop.

FIG. 10 is an exploded perspective view of a fork 180 from which a rigid central portion 190 is added between the rigid function portion 101 and the holder 103 of the fork 100 in FIG. 3. Two flexible connectors 118 are used to link the rigid central portion 190 with the rigid function portion 101 and the holder 103. The rigid central portion 190 has a third linking part 196 used for linking with the second linking part 112, and a fourth for linking part 196 used for linking with the first linking part 116. The third linking part 196 formed at one end of the rigid central portion 190 has the same structure and function to the first linking part 116. The fourth linking part 192 has the same structure and function to the second linking part 112. The fork 180 forms a loop when the male linker 102 is engaged with the female linker 106 of the holder 103, as shown in FIG. 12. The fork 180 forms a normal use fork which has the two flexible connectors 118 received in the inner of the fork when the first linking part 116 is engaged with the fourth linking part 192 and the second linking part 112 is engaged with the third linking part 192, as shown in FIG. 11. It is to be understood that the rigid central portion 190 is used to increase a length of the fork 180.

Embodiment 2

FIGS. 13-17 show aspects of a loopable and wearable spoon in the embodiment 2 of the present invention.

Figure 13:
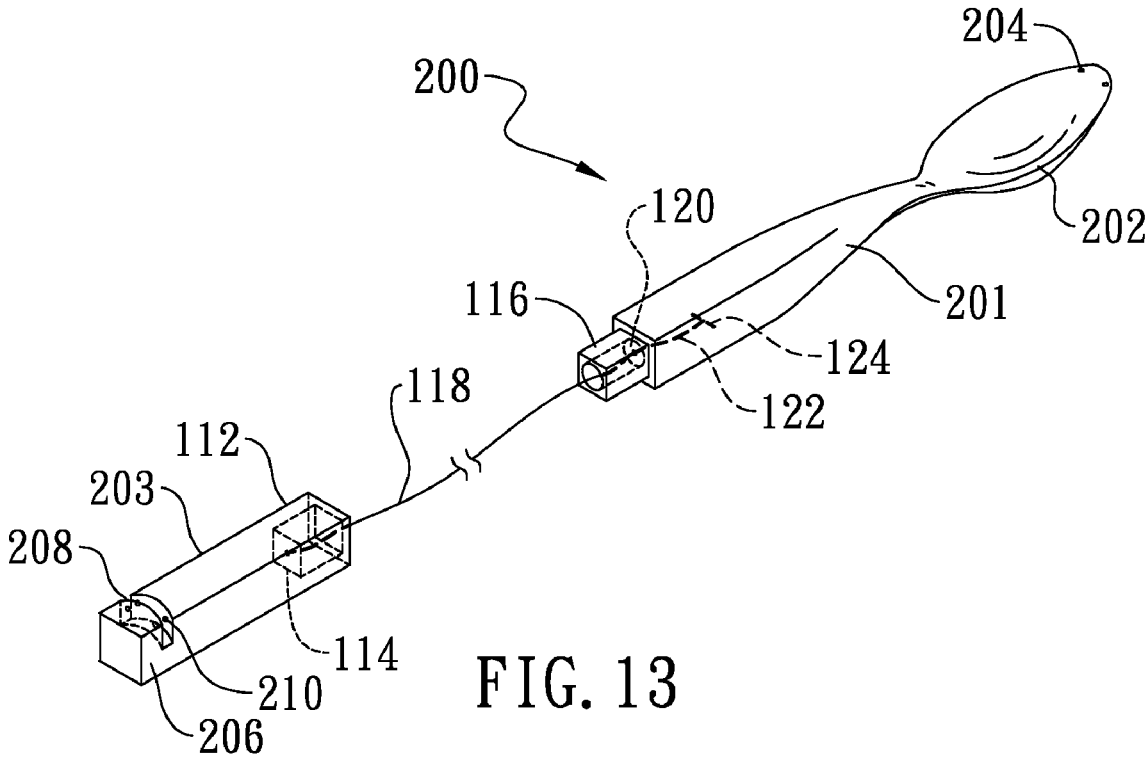
FIG. 13 is an exploded perspective view of a loopable and wearable spoon.
Figure 14:
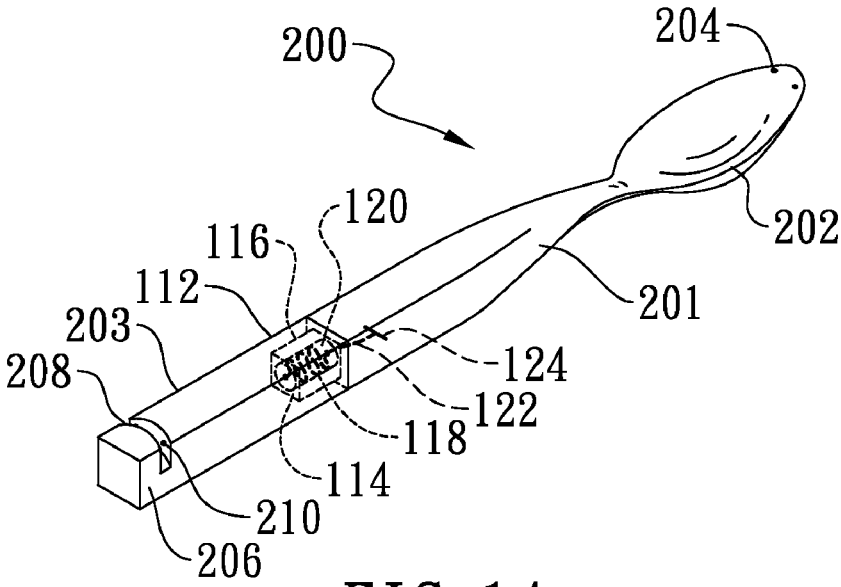
FIG. 14 is a perspective view of the spoon of FIG. 13 forming a normal use spoon.
Figure 16:
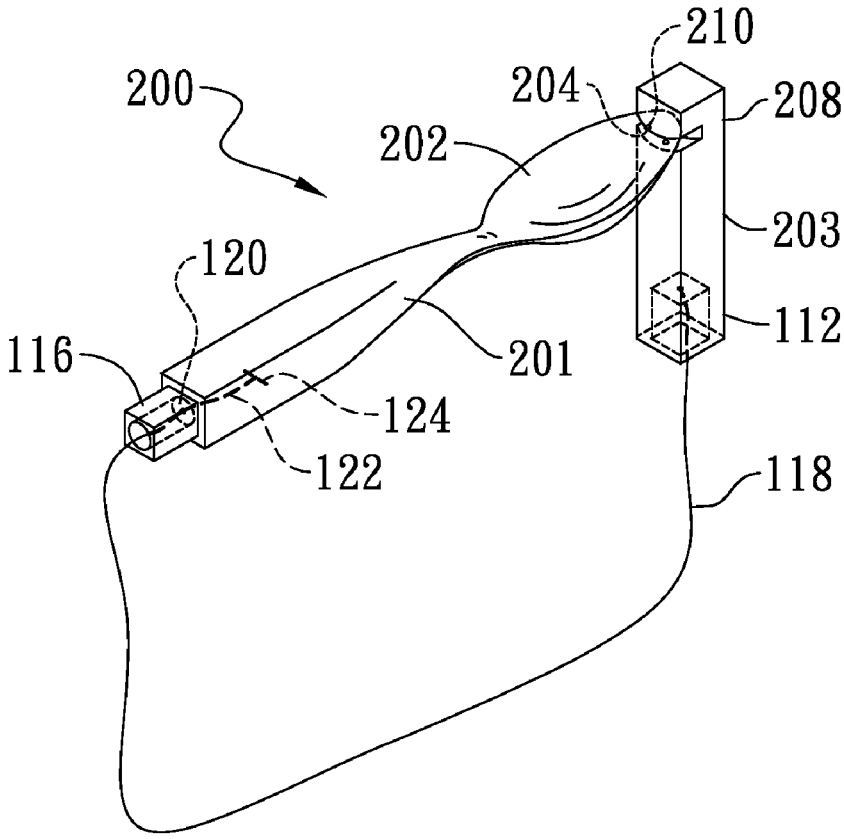
FIG. 16 is a perspective view of the spoon of FIG. 13 forming a loop.

FIG. 13 is an exploded perspective view of a loopable and wearable spoon. As shown in FIG. 13, a spoon 200 includes a rigid function portion 201, a holder 203 and a flexible connector 118. The rigid function portion 101 in the embodiment 2 has a spoon terminating at one end in a arc tip which is intended to ladle portions of food and the arc tip also serve as a male linker 102. The opposite end of the rigid function portion 201 has a first linking part 116 which is of a round cross-section. The holder 203 is intended to hold the spoon 200 and one end of the holder 203 serves as a female linker 206 used for linking with the male linker 202, and the opposite end has a second linking part 112 used for linking with the first linking part 116. The flexible connector 118 intended to connect the rigid function portion 201 and the holder 203 has a flexible member 122 and a stopper 124. The spoon 200 forms a loop when the male linker 202 is engaged with the female linker 206 of the holder 203, as shown in FIG. 16. The spoon 200 forms a normal use spoon which has the flexible connector 118 received in the inner of the spoon when the first linking part 116 is engaged with the second linking part 112 of the holder 203, as shown in FIG. 14.

Figure 15A:
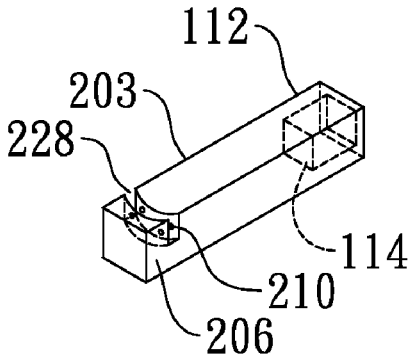
FIGS. 15A and 15B are perspective views of a holder of the spoon.
Figure 15B:
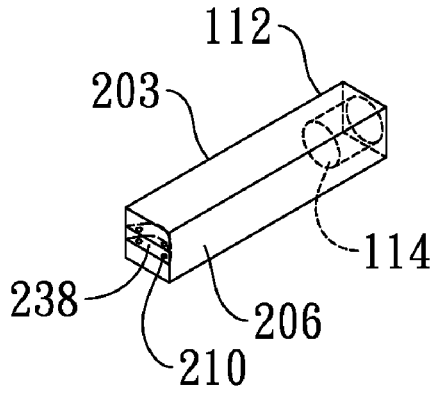

A cavity 208 for engaging with the male linker 202 is formed in the female linker 206 of the holder 203. Dents 204 for locking with knots 210 which are formed on each middle site of sidewalls of the cavity 208 are formed on the tip of the male linker 202. A shape of the cavity 208 is adopted to fit the male linker 202 resulting in matched coupling formed by the cavity 208 and the male linker 202. A cavity can be formed in the bottom side of female linker 206 such as cavity 238 shown in FIG. 15B, and can be a shape of cavity that the concave side of spoon face outwardly when the male linker 202 is engaged with the cavity such as cavity 228 shown in FIG. 15A. FIGS. 15A and 15B are perspective views of a holder. A cross-section shape of the recess in the second linking part 112 is a square in FIG. 15A, otherwise, a circle in FIG. 15B.

Figure 17:
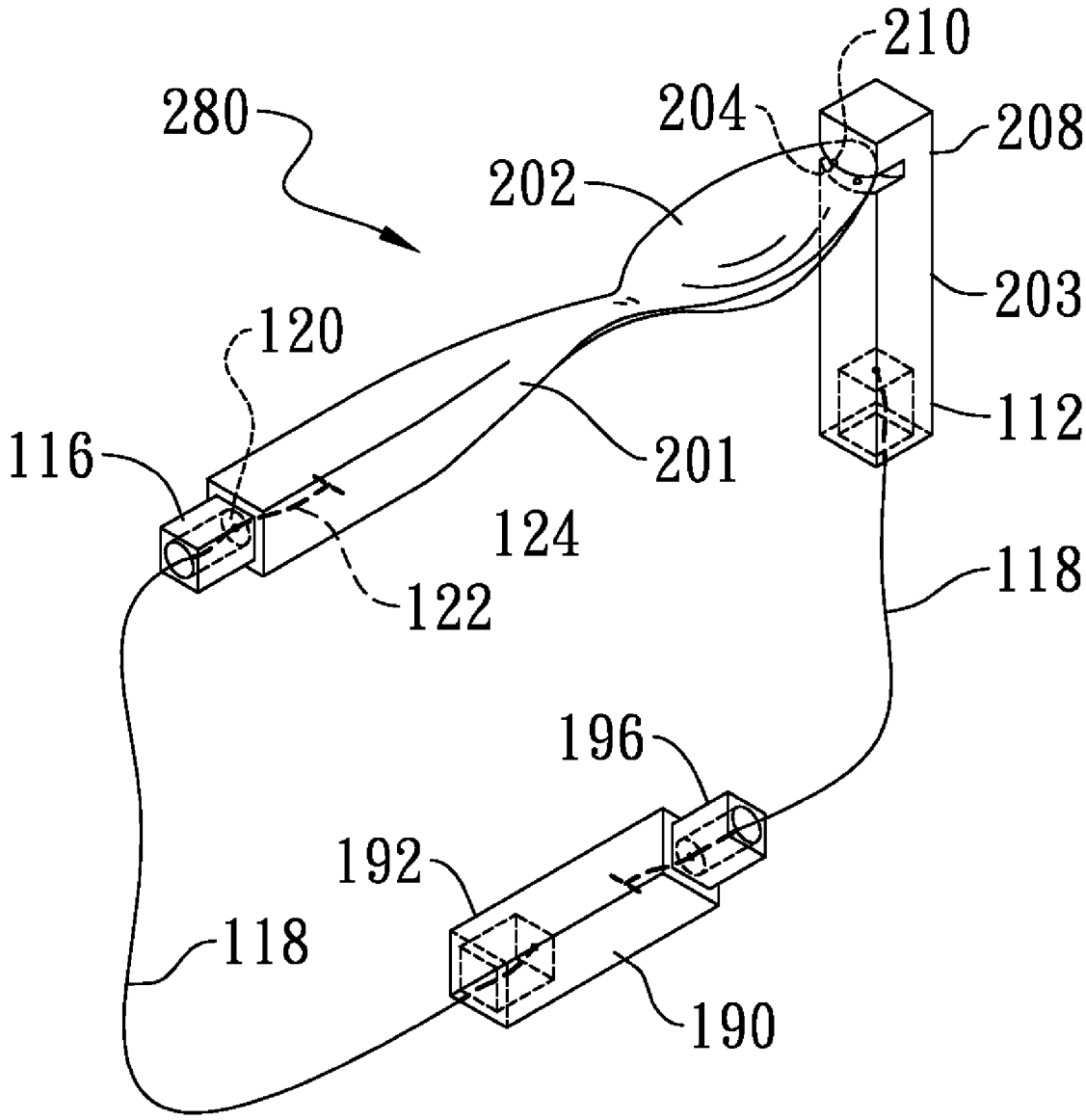
FIG. 17 is an exploded perspective view of a spoon from which a rigid central portion is added to the spoon of FIG. 13.

FIG. 17 is a perspective view of a loop-shaped spoon 280 from which a rigid central portion 190 is added between the rigid function portion 201 and the holder 203 of the spoon 200 in FIG. 13. Two flexible connectors 118 are used to link the rigid central portion 190 with the rigid function portion 201 and the holder 203. Structures and functions of the rigid central portion 190 are described in embodiment 1.

Embodiment 3

FIGS. 18-23 show aspects of a loopable and wearable chopstick in the embodiment 3 of the present invention.

Figure 18:
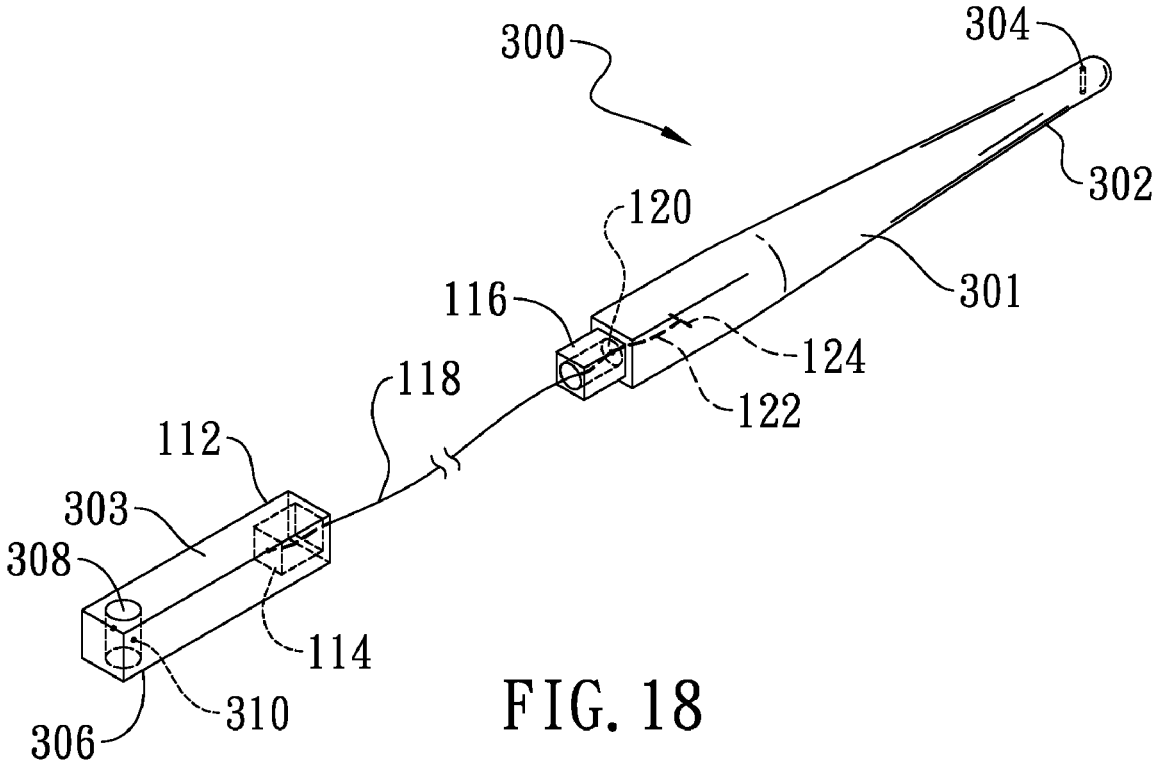
FIG. 18 is an exploded perspective view of a loopable and wearable chopstick.
Figure 19:
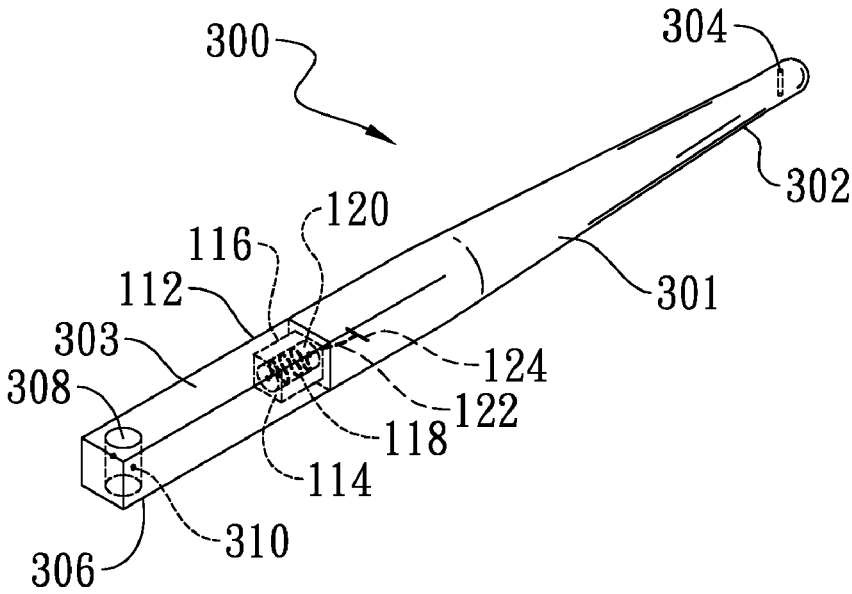
FIG. 19 is a perspective view of the chopstick of FIG. 13 forming a normal use chopstick.
Figure 20:
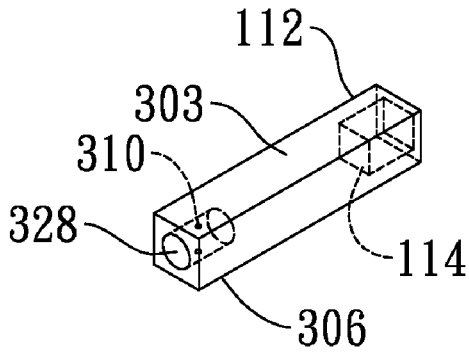
FIG. 20 is a perspective view of a holder of the chopstick.
Figure 21:
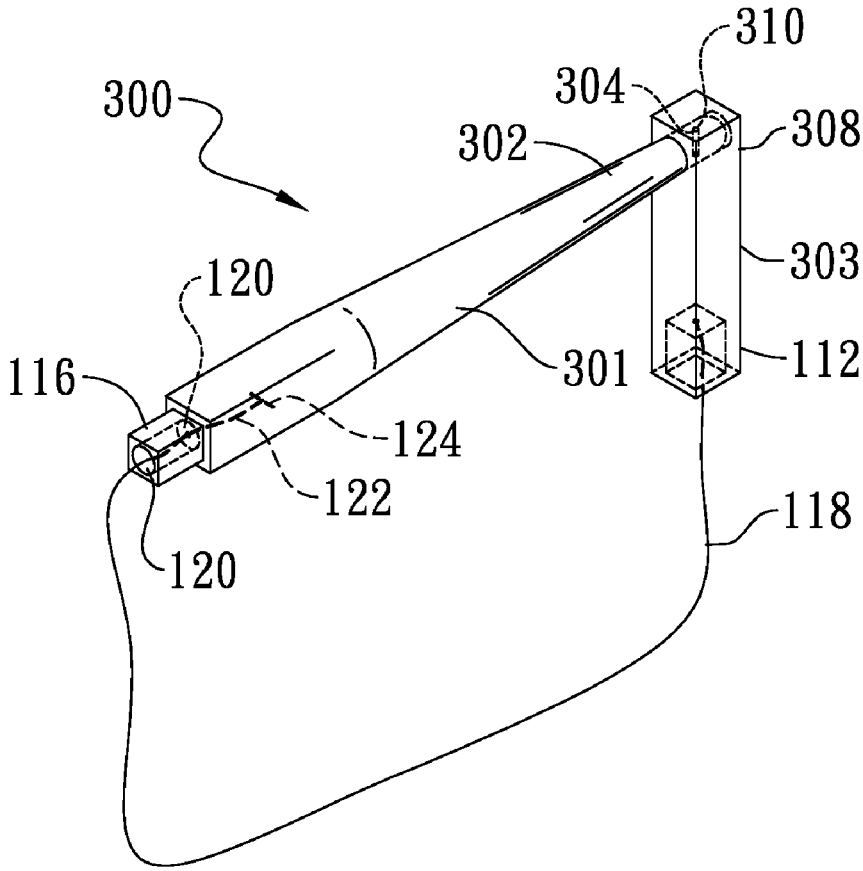
FIG. 21 is a perspective view of the chopstick of FIG. 13 forming a loop.

FIG. 18 is an exploded perspective view of a loopable and wearable chopstick. As shown in FIG. 18, a chopstick 300 includes a rigid function portion 301, a holder 303 and a flexible connector 118. The rigid function portion 301 in the embodiment 2 has a chopstick terminating at one end in a rounded tip which is intended to engage portions of food and the rounded tip also serve as a male linker 302. The opposite end of the rigid function portion 301 has a first linking part 116 which is of a round cross-section. The holder 303 is intended to hold the chopstick 300 and one end of the holder 303 serves as a female linker 306 used for linking with the male linker 302, and the opposite end has a second linking part 112 used for linking with the first linking part 116. The flexible connector 118 intended to connect the rigid function portion 301 and the holder 303 has a flexible member 122 and a stopper 124. The chopstick 300 forms a loop when the male linker 302 is engaged with the female linker 306 of the holder 303, as shown in FIG. 21. The chopstick 300 forms a normal use chopstick which has the flexible connector 118 received in the inner of the chopstick when the first linking part 116 is engaged with the second linking part 112 of the holder 303, as shown in FIG. 19.

A cavity 308 for engaging with the male linker 302 is formed in the female linker 306 of the holder 303. Dents 304 for locking with knots 310 which are formed on each middle site of sidewalls of the cavity 308 are formed on the tip of the male linker 302. A shape of the cavity 308 is adopted to fit the male linker 302 resulting in matched coupling formed by the cavity 308 and the male linker 302. A cavity can be formed in the bottom side of female linker 306 such as cavity 328 shown in FIG. 20.

Figure 22:
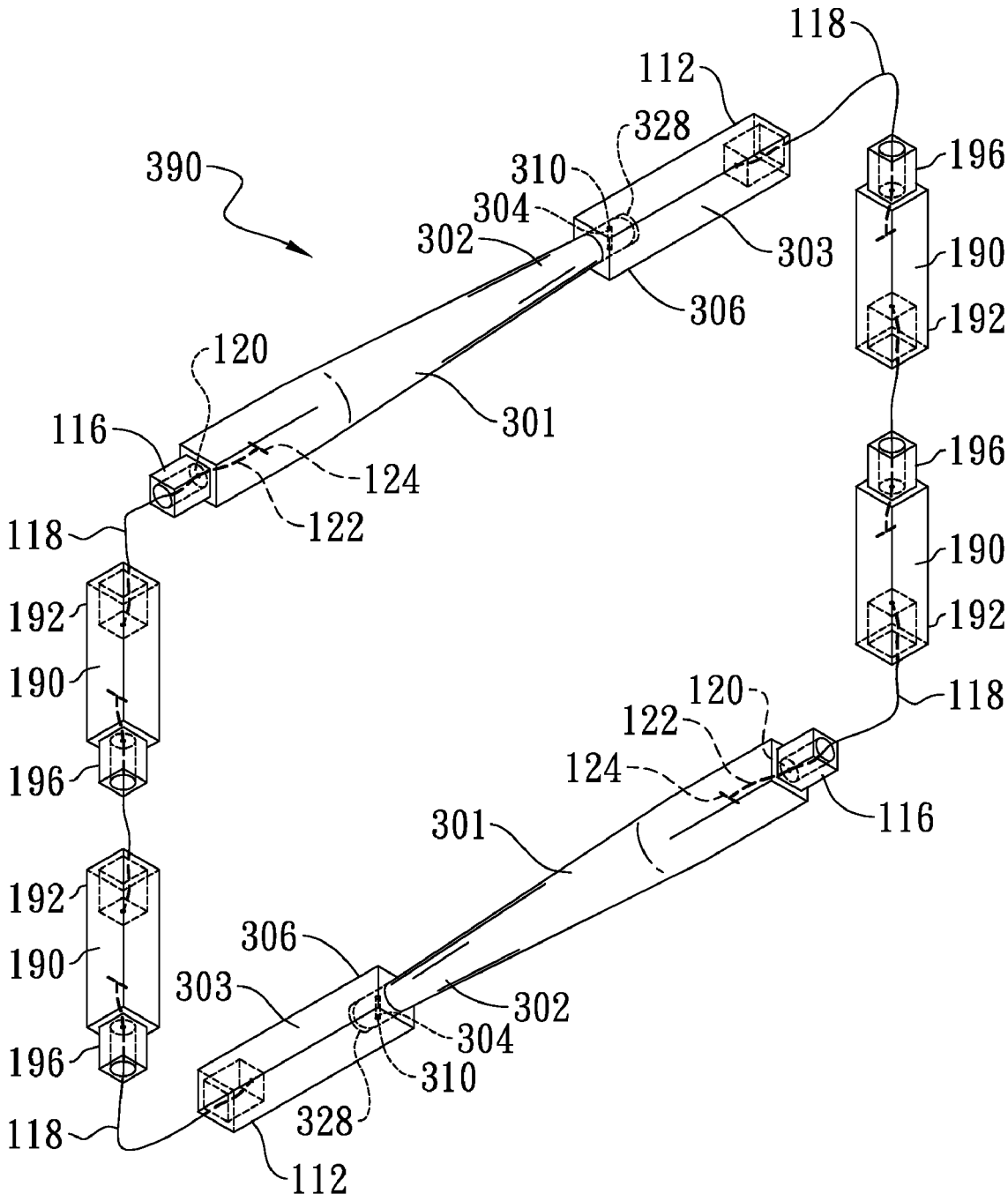
FIG. 22 is a perspective view of a pair of chopsticks loop-shaped from which two rigid central portions are added to the chopstick of FIG. 18.

FIG. 22 is a perspective view of a pair of chopsticks 390 loop-shaped from which two rigid central portions 190 are added between the rigid function portion 301 and the holder 303 of each the chopstick 300 in FIG. 18, wherein two chopsticks are mutually engaged through heads and tails forming a loop. Two flexible connectors 118 are used to link the rigid central portion 190 with the rigid function portion 301 and the holder 303. Structures and functions of the rigid central portion 190 are described in embodiment 1.

Figure 23:
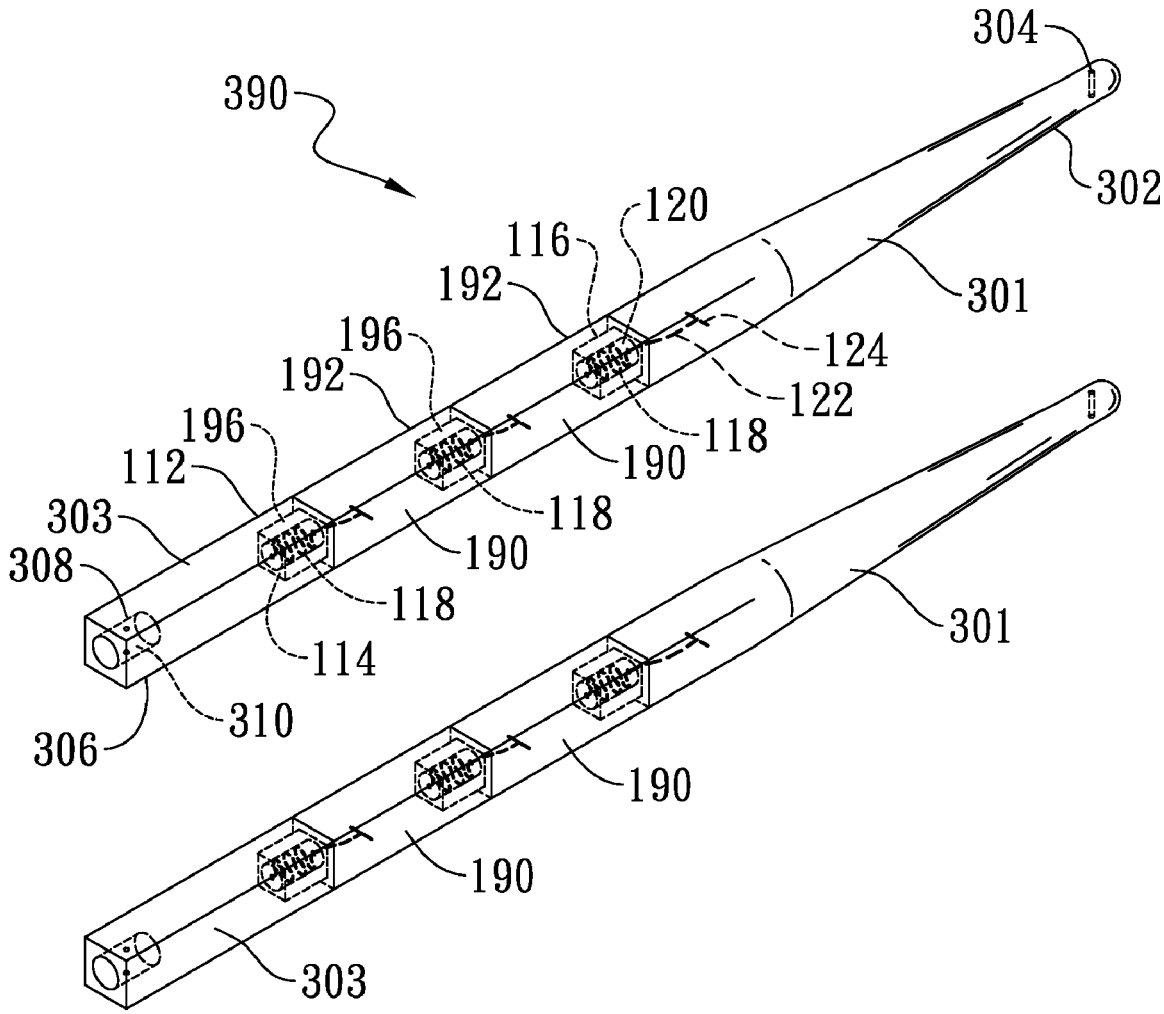
FIG. 23 is a perspective view of the chopsticks of FIG. 22 forming a pair of normal use chopsticks.

The pair of chopsticks 390 form normal use chopsticks which have the flexible connectors 118 received in the inner of the chopsticks when the rigid function portion 301, two rigid central portions 190 and the holder 303 are connected tightly, as shown in FIG. 23. It is to be understood that the rigid central portion 190 is used to increase a length of the pair of chopsticks 390.

Embodiment 4

Figure 24:
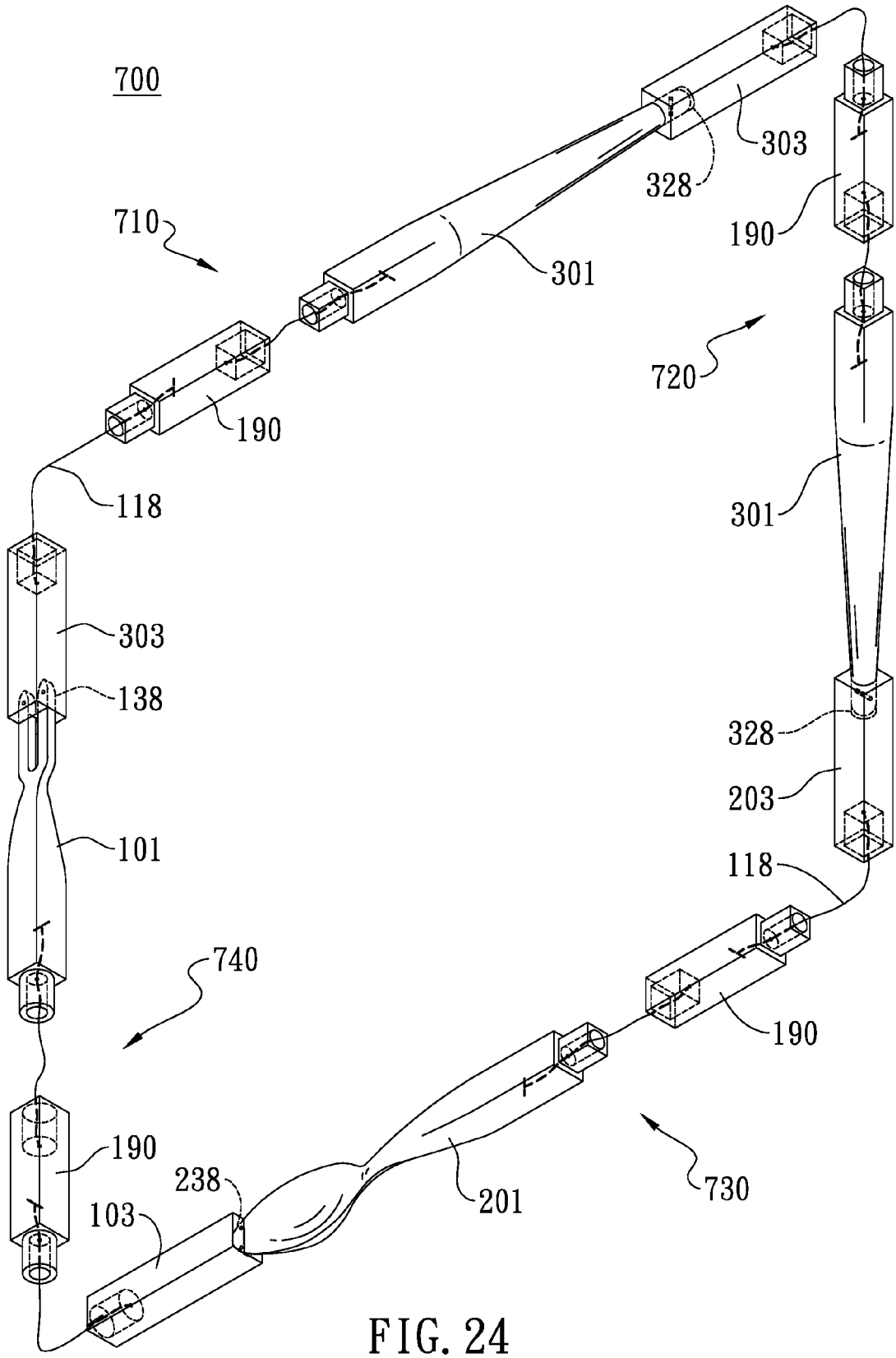
FIG. 24 is a perspective view of a set of dining utensils forming a loop including a chopstick a chopstick, a spoon and a fork.

FIG. 24 is a perspective view of a set of dining utensils forming a loop 700 including a chopstick 710, a chopstick 720, a spoon 730 and a fork 740. The chopstick 710 includes the rigid function portion 301, the rigid central portions 190 and the holder 303 with cavities 138. The chopstick 720 includes the rigid function portion 301, the rigid central portions 190 and the holder 303 with cavity 328. The spoon 730 includes the rigid function portion 201, the rigid central portions 190 and the holder 203 with cavity 328. The fork 740 includes the rigid function portion 101, the rigid central portions 190 and the holder 103 with cavity 238. The four dining utensils are correspondingly engaged through heads and tails forming the loop 700.

Figure 25:
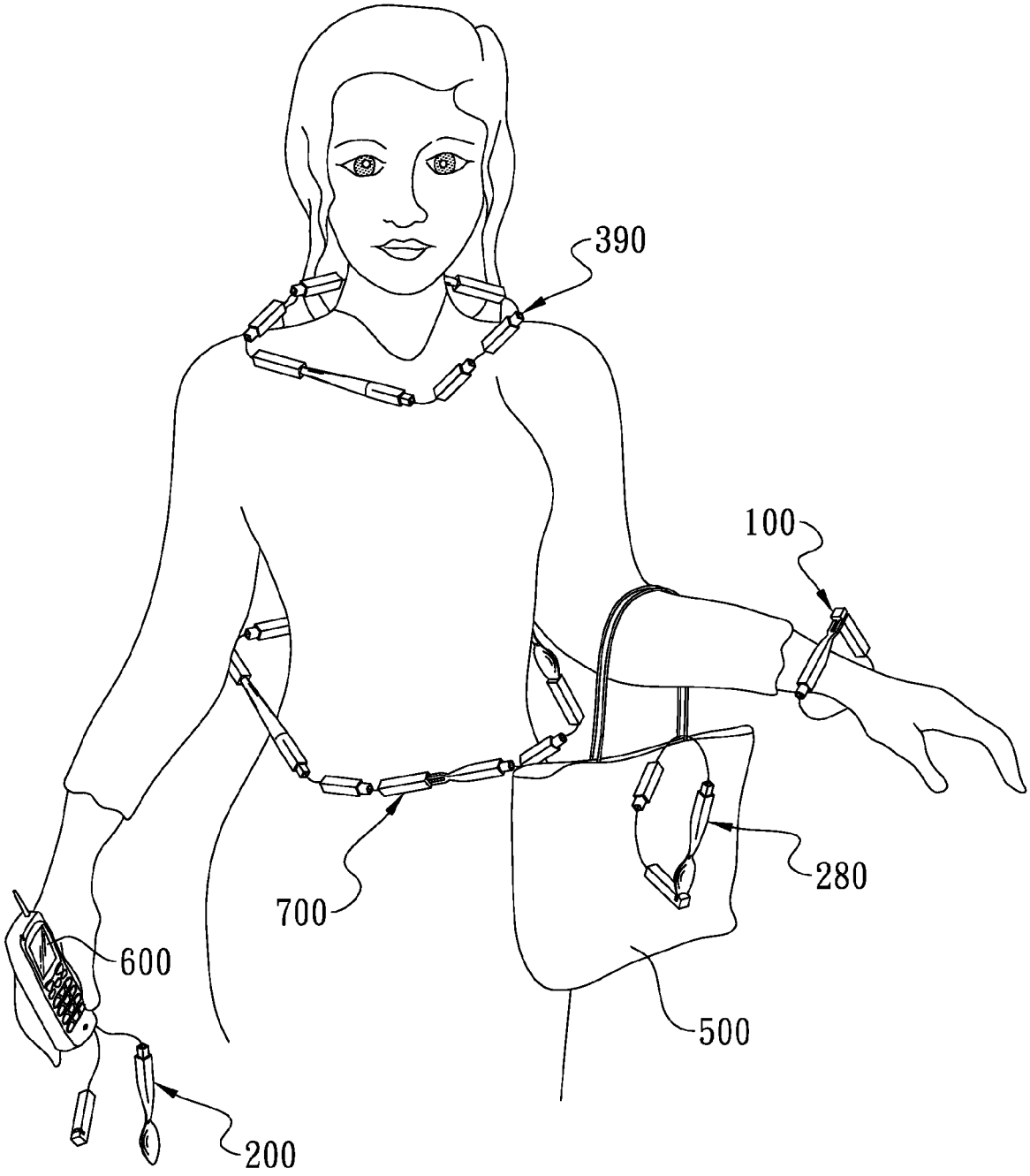
FIG. 25 is a perspective view of practical examples of loopable and wearable dining utensils.

FIG. 25 shows practical examples of loopable and wearable dining utensils such as a chopstick, a fork or a spoon in the embodiment 4 of the present invention, wherein the multiple dining utensils can form a bracelet, necklace, belt or an ornament of handbag or hand-held mobile device according to various connecting profiles. FIG. 25 is a perspective view of practical examples of loopable and wearable dining utensils. As shown in FIG. 25, the loop-shaped fork 100 of FIG. 9 like a bracelet is put around a wrist of user. Moreover, the spoon 200 of FIG. 13 is hanged on a mobile phone 600 held in the user's hand; the loop-shaped spoon 280 of FIG. 17 is put to decorate a handbag 500; and the pair of chopsticks 390 of FIG. 22 like a necklace is put around the neck of the user. Then, the loop 700 of FIG. 24 like a belt is put around the waist of the user.

Compared to conventional portable dining utensils, the present invention has several advantages. First, the embodiments enable dining utensils to be loopable and wearable by using simple structure and easy assembly to form a bracelet, necklace, belt or an ornament of handbag or hand-held mobile device. This is an extremely unique creation that integrates dining utensils and personal ornaments into one product. Second, since a carrying case is excluded, a carrying volume is reduced and burden of user is also relieved, and that dining utensils also personal ornaments triggers user to bear when eating outside on weekdays. Moreover, due to the exclusion of the carrying case, materials to produce the case can be reserved to benefit environmental protection. In addition, antibacterial plastic, ceramics, stainless steel or other metals can be employed to produce dining utensils, thus the cleanness and sanitation of the loopable and wearable dining utensil can be maintained.

What is claimed is:

1. A loopable and wearable dining utensil, comprising:

a rigid function portion with a tip terminating at one end for engaging food, wherein the tip also serves as a male linker and the opposite end of the rigid function portion has a first linking part;

a holder with one end serving as a female linker and the opposite end having a second linking part, wherein the female linker is used for linking with the male linker and the second linking part is used for linking with the first linking part; and a flexible connector, for connecting the rigid function portion and the holder, wherein the dining utensil forms a loop when the male linker is engaged with the female linker and the dining utensil forms a normal use dining utensil which has the flexible connector received in the inner of the dining utensil when the first linking part is engaged with the second linking part.

2. The loopable and wearable dining utensil as recited in claim 1, further comprising a rigid central portion located between the rigid function portion and the holder for increasing a length of the dining utensil.

3. The loopable and wearable dining utensil as recited in claim 1, wherein the dining utensil is a chopstick, a spoon or a fork.

4. The loopable and wearable dining utensil as recited in claim 1, wherein the flexible connector is a wire, a twist wire or a chain with functions of bending, winding, folding, elongating or shrinking, and formed with elastic material, and fixed on the rigid function portion and the holder through using glue or metal welding.

5. The loopable and wearable dining utensil as recited in claim 1, wherein the first linking part and the second linking part each has a bottom shield with a outlet, and each end of the flexible connector has a stopper going though the outlet causing moveable connection.

6. The loopable and wearable dining utensil as recited in claim 1, wherein the dining utensil can form a bracelet, necklace, belt or an ornament of handbag or hand-held mobile device through various connecting profiles.

7. The loopable and wearable dining utensil as recited in claim 1, wherein the female linker has a cavity whose shape is adopted to fit the male linker resulting in matched coupling, and the tip of the male linker has dents for locking with knots formed on each middle site of sidewalls of the cavity.

8. The loopable and wearable dining utensil as recited in claim 1, wherein a cross-section shape of the second linking part and of the first linking part is a circle, curve, square or rectangle, and an external diameter of the first linking part is about equal to an internal diameter of the second linking part causing a tight connection.

9. A loopable and wearable chopstick, comprising:

a rigid function portion with a rounded tip terminating at one end for engaging food, wherein the rounded tip also serves as a male linker and the opposite end of the rigid function portion has a first linking part;

a holder with one end serving as a female linker and the opposite end having a second linking part, wherein the female linker is used for linking with the male linker and the second linking part is used for linking with the first linking part; and a flexible connector, for connecting the rigid function portion and the holder, wherein the chopstick forms a loop when the male linker is engaged with the female linker and the chopstick forms a normal use chopstick which has the flexible connector received in the inner of the chopstick when the first linking part is engaged with the second linking part.

10. The loopable and wearable chopstick as recited in claim 9, further comprising a rigid central portion located between the rigid function portion and the holder for increasing a length of the chopstick.

11. The loopable and wearable chopstick as recited in claim 9, wherein the flexible connector is a wire, a twist wire or a chain with functions of bending, winding, folding, elongating or shrinking, and formed with elastic material, and fixed on the rigid function portion and the holder through using glue or metal welding.

12. The loopable and wearable chopstick as recited in claim 9, wherein the first linking part and the second linking part each has a bottom shield with a outlet, and each end of the flexible connector has a stopper going though the outlet causing moveable connection.

13. The loopable and wearable chopstick as recited in claim 9, wherein the chopstick can form a bracelet, necklace, belt or an ornament of handbag or hand-held mobile device through various connecting profiles.

14. The loopable and wearable chopstick as recited in claim 9, wherein the female linker has a cavity whose shape is adopted to fit the male linker resulting in matched coupling, and the rounded tip of the male linker has dents for locking with knots formed on each middle site of sidewalls of the cavity.

15. A loopable and wearable spoon, comprising:

a rigid function portion with a arc tip terminating at one end for ladling food, wherein the arc tip also serves as a male linker and the opposite end of the rigid function portion has a first linking part;

a holder with one end serving as a female linker and the opposite end having a second linking part, wherein the female linker is used for linking with the male linker and the second linking part is used for linking with the first linking part; and a flexible connector, for connecting the rigid function portion and the holder, wherein the spoon forms a loop when the male linker is engaged with the female linker and the spoon forms a normal use spoon which has the flexible connector received in the inner of the spoon when the first linking part is engaged with the second linking part.

16. The loopable and wearable spoon as recited in claim 15, further comprising a rigid central portion located between the rigid function portion and the holder for increasing a length of the spoon.

17. The loopable and wearable spoon as recited in claim 15, wherein the flexible connector is a wire, a twist wire or a chain with functions of bending, winding, folding, elongating or shrinking, and formed with elastic material, and fixed on the rigid function portion and the holder through using glue or metal welding.

18. The loopable and wearable spoon as recited in claim 15, wherein the first linking part and the second linking part each has a bottom shield with a outlet, and each end of the flexible connector has a stopper going though the outlet causing moveable connection.

19. The loopable and wearable spoon as recited in claim 15, wherein the spoon can form a bracelet, necklace, belt or an ornament of handbag or hand-held mobile device through various connecting profiles.

20. The loopable and wearable spoon as recited in claim 15, wherein the female linker has a cavity whose shape is adopted to fit the male linker resulting in matched coupling, and the arc tip of the male linker has dents for locking with knots formed on each middle site of sidewalls of the cavity.

* * * * *